US010115306B2

(12) United States Patent
Agrawal et al.

(10) Patent No.: US 10,115,306 B2
(45) **Date of Patent: *Oct. 30, 2018**

(54) PARKING IDENTIFICATION AND AVAILABILITY PREDICTION

(71) Applicant: Uber Technologies, Inc., San Francisco, CA (US)

(72) Inventors: Laxmikant Agrawal, Bellevue, WA (US); Sudheer Pratipati, Redmond, WA (US); Audrey Colle, Bellevue, WA (US); Jose De Oliveira, Redmond, WA (US); Jeff Couckuyt, Bothell, WA (US)

(73) Assignee: Uber Technologies, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/676,396

(22) Filed: Aug. 14, 2017

(65) Prior Publication Data

US 2017/0345303 A1 Nov. 30, 2017

Related U.S. Application Data

(63) Continuation of application No. 14/548,179, filed on Nov. 19, 2014, now Pat. No. 9,767,690.

(51) Int. Cl.
*G08G 1/14* (2006.01)
*G08G 1/01* (2006.01)

(52) U.S. Cl.
CPC ..... *G08G 1/14* (2013.01); *G08G 1/012* (2013.01); *G08G 1/0129* (2013.01); (Continued)

(58) Field of Classification Search
CPC ..... G08G 1/14; G08G 1/141; G08G 1/146; G08G 1/147; G08G 1/148; G01C 21/3679; G01C 21/3682; G01C 21/3685
See application file for complete search history.

(56) References Cited

U.S. PATENT DOCUMENTS 8,090,402 B1 1/2012 Fujisaki
8,779,940 B2 7/2014 Amir
(Continued)

FOREIGN PATENT DOCUMENTS

WO WO 2014/117016 A1 7/2014
WO WO 2014/139749 A1 9/2014

OTHER PUBLICATIONS

PCT International Search Report and Written Opinion, PCT Application No. PCT/US2015/061702, dated Mar. 2, 2016, 13 pages.
(Continued)

*Primary Examiner* — Van Trieu
(74) *Attorney, Agent, or Firm* — Fenwick & West LLP

(57) ABSTRACT

A system includes a model generating component to generate a prediction tree model based on training data and an input component to receive input data including a destination in a geographical area. A computation component identifies at least one parking venue or at least one parking space near the destination in the geographical area and to generate at least one parking prediction corresponding to the at least one parking venue or the at least one parking space based at least in part on applying the input data to the prediction tree model. A presentation component presents the at least one parking venue or the at least one parking space and to present the at least one parking prediction to a user.

20 Claims, 8 Drawing Sheets

(52) U.S. Cl.
CPC ..... *G08G 1/0141* (2013.01); *G08G 1/143* (2013.01); *G08G 1/144* (2013.01); *G08G 1/146* (2013.01); *G08G 1/147* (2013.01); *G08G 1/148* (2013.01)

(56) References Cited

U.S. PATENT DOCUMENTS

| | | | |
|---|---|---|---|
| 8,779,941 | B2 | 7/2014 | Amir |
| 2005/0096974 | A1 | 5/2005 | Chagoly et al. |
| 2009/0204319 | A1 | 8/2009 | Shanbhag et al. |
| 2010/0042318 | A1 | 2/2010 | Kaplan et al. |
| 2012/0072096 | A1 | 3/2012 | Chapman et al. |
| 2012/0161985 | A1 | 6/2012 | Amir |
| 2012/0161986 | A1 | 6/2012 | Amir |
| 2012/0265434 | A1 | 10/2012 | Woodard et al. |
| 2013/0268469 | A1 | 10/2013 | Sharma et al. |
| 2014/0236478 | A1 | 8/2014 | Mermelstein |
| 2014/0266800 | A1 | 9/2014 | Koukoumidis et al. |
| 2015/0213715 | A1 | 7/2015 | Schulz |
| 2015/0294431 | A1 | 10/2015 | Fiorucci et al. |
| 2015/0345965 | A1 | 12/2015 | Semsey |

OTHER PUBLICATIONS

United States Office Action, U.S. Appl. No. 14/548,179, dated Sep. 16, 2016, 16 pages.
United States Office Action, U.S. Appl. No. 14/548,179, dated Jan. 11, 2016, 15 pages.
Australian First Examination Report, Australian Application No. 2015349821, dated Nov. 15, 2017, 3 pages.
Canadian Office Action, Canadian Application No. 2,968,379, dated Oct. 23, 2017, 4 pages.
Australian Second Examination Report, Australian Application No. 2015349821, dated Jul. 26, 2018, three pages.
European Patent Office, Extended European Search Report and Opinion, EP Patent Application No. 15860154.2, dated Jun. 29, 2018, eight pages.

Table 200

| | Venue | Address (206A) | Number of Parking Spaces (206B) | Indoor or Outdoor (206C) | Type of Parking (206D) | Size of Parking Spaces | Fee Structure | Hours of Operation | On-Site Equipment | Limitations | Payment Options |
|---|---|---|---|---|---|---|---|---|---|---|---|
| 202 | PMC Parking | 710 SW Jefferson St | 48 | Indoor | Self | Standard | $8 early bird before 7am<br><br>$9 between 7am and 5pm | Open from 12am to 5pm | Charging station | No overnight parking<br><br>Closed weekends and holidays<br><br>No vehicles over 8'2" | Credit or cash accepted |
| 204 | ACE Lot | 159 SW Jefferson St | 26 | Indoor | Valet only | Oversize | $8 all day any day of the week | Open 24 hours | Charging station | No vehicles over 7' | Credit only |
| | U-Park Systems | 1149 SW Market St | 10 | Outdoor | Valet or Self | Standard oversize, and RV | $5 weekend all day<br><br>$10 weekday all day | Open from 6am to 6pm | None | Closed from 6pm to 6am | Credit or cash accepted |
| | Smart Park | 350 SW Market St | 23 | Indoor | Self | Standard | $10 all day any day of the week | Open 24 hours | Charging station | No vehicles over 8' | Cash only |

Fig. 2

PARKING IDENTIFICATION AND AVAILABILITY PREDICTION

CROSS REFERENCE TO RELATED APPLICATIONS

This application is a continuation of U.S. application Ser. No. 14/548,179, now U.S. Pat. No. 9,767,690, filed Nov. 19, 2014, which is incorporated by reference in its entirety.

TECHNICAL FIELD

The present disclosure relates to identifying available parking near a destination and predicting the availability of the identified parking.

BACKGROUND

Drivers spend an inordinate amount of time searching for available parking venues or parking spaces near their intended destination. In addition to wasting time, a driver's search for available parking can cause the driver stress and adversely impact traffic conditions in the area surrounding the intended destination as the driver circles the block time and time again. Proposed solutions to address the problem include mounting sensors to the road surface or to the vehicle that can detect available parking. These proposed solutions are costly, only partially address the problem, and remain largely unimplemented.

BRIEF DRAWINGS DESCRIPTION

The present disclosure describes various embodiments that may be understood and fully appreciated in conjunction with the following drawings:

FIG. 1 diagrams an embodiment of a parking identification and availability prediction system according to the present disclosure;

FIG. 2 is an exemplary tabular view of training data according to the present disclosure;

FIG. 3 diagrams an embodiment of a prediction tree according to the present disclosure;

Figure 7:
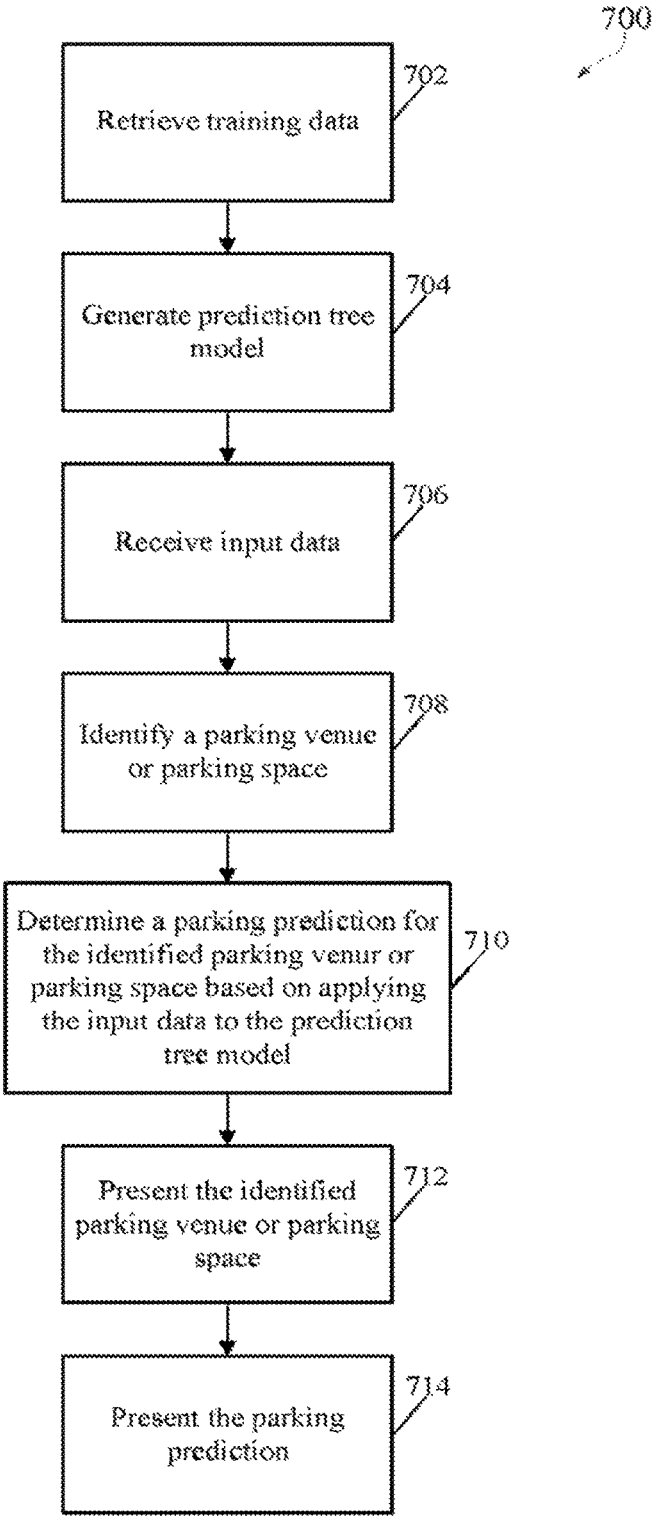
Figure 8:
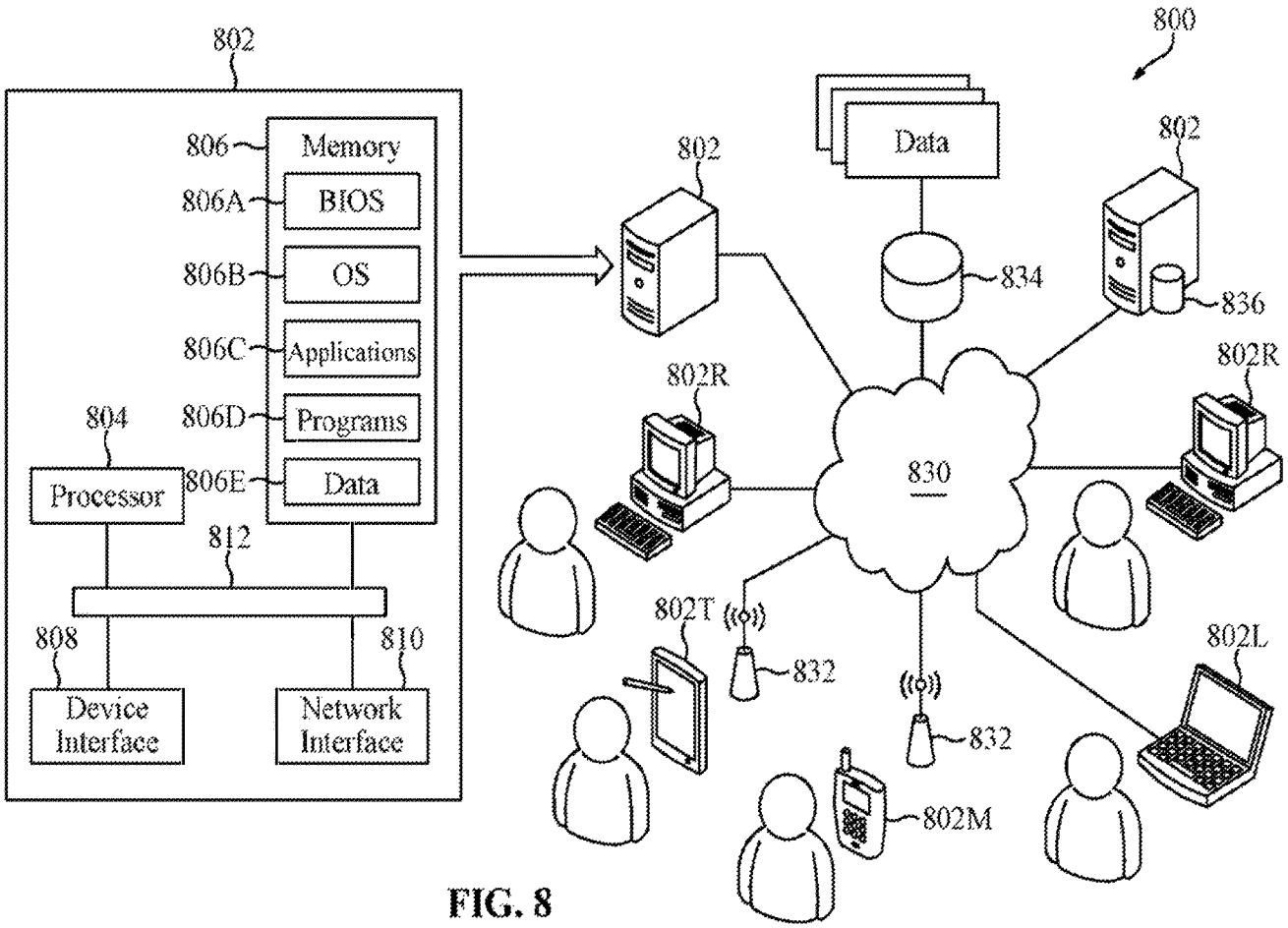

FIG. 7 diagrams an embodiment of a method of identifying parking and predicting availability of identified parking; and FIG. 8 diagrams an embodiment of a computing system that executes the parking identification and availability prediction system according to the present disclosure.

DETAILED DESCRIPTION

The present disclosure describes embodiments with reference to the drawing figures listed above. Persons of ordinary skill in the art will appreciate that the description and figures illustrate rather than limit the disclosure and that, in general, the figures are not drawn to scale for clarity of presentation. Such skilled persons will also realize that many more embodiments are possible by applying the inventive principles contained herein and that such embodiments fall within the scope of the disclosure which is not to be limited except by the claims.

The present disclosure describes a parking identification and availability prediction system that may identify parking venues or parking spaces near a destination and that may predict availability of the identified parking venues or parking spaces by generating a prediction tree model based on training data. The training data may comprise records for each of a plurality of parking venues or parking spaces, each parking venue or parking space having associated therewith an address, a number of parking spaces, an indoor or outdoor designation, a type of parking service offered, a size of each of the number of parking spaces, fee structure, hours of operation, on-site equipment, limitations, payment options, or any other information related to the parking space or parking venue. The system may receive input data from a user including a destination in a geographical area. The system may identify the parking venues or parking spaces near the destination in the geographical area and may generate a parking prediction corresponding to the identified parking venues or parking spaces based on applying the input data to the prediction tree model. The system may present the user with directions to the destination, directions to the identified parking venues or parking spaces along with the parking prediction. The parking prediction may indicate the probability that the parking venues or parking spaces will be available for parking at a time the driver searches for the destination or is scheduled to arrive at the destination.

Figure 1:
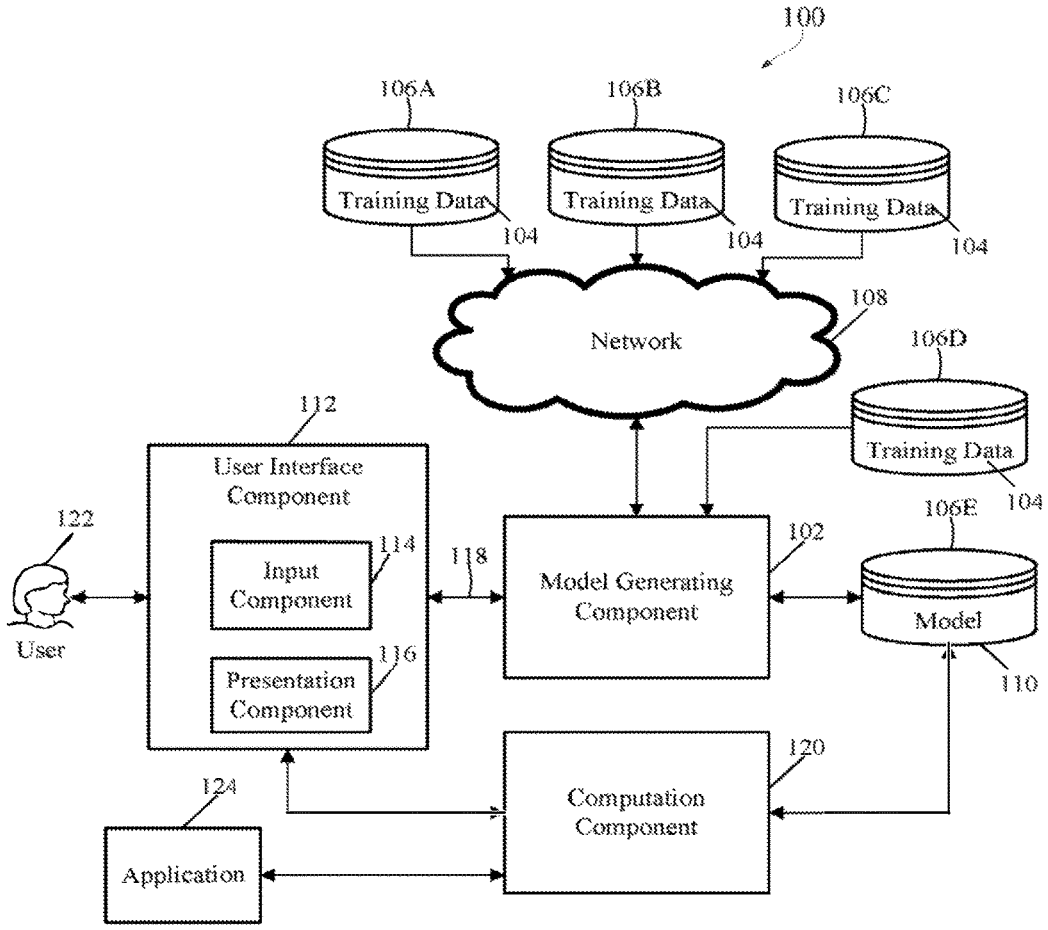

FIG. 1 diagrams an embodiment of a parking identification and prediction availability system according to the present disclosure. Referring to FIG. 1, a system 100 may include a model generating component 102 that generates a prediction model 110 based on training data 104 retrieved from data sources, memory devices, or memory components 106A, 106B, 106C, and/or 106D. Training data 104 may generally be any kind of data, hierarchical or otherwise, related to any number of parking venues or parking spaces and obtained from any of a variety of sources, including information sources available through network 108 and crowd-sourced information provided to system 100. Training data 104 may include records for each of a plurality of parking venues or parking spaces, each parking venue or parking space having associated therewith an address, a number of parking spaces, an indoor or outdoor designation, a type of parking service offered, a size of each of the number of parking spaces, fee structure, hours of operation, on-site equipment, limitations, payment options, or the like as shown in Table 200 in FIG. 2.

Although training data 104 is shown in tabular form in table 200, training data 104 may be organized as a database of records, relational or otherwise, or as a dataset comprising a collection of related sets of information that is composed of separate elements but that may be manipulated as a unit. Training data 104 and model 110 may be stored in any number of data sources, memory devices, or memory components 106A, 106B, 106C, 106D, and/or 106E located geographically distant or near to model generating component 102. Data sources, memory devices, or memory components 106A, 106B, 106C, 106D, and/or 106E may be any kind of memory capable of storing data, e.g., volatile memory (e.g., registers, cache, random access memory (RAM), and the like) and non-volatile memory (e.g., read only memory (ROM), electrically erasable programmable read only memory (EEPROM), flash memory, magnetic random access memory (MRAM), and the like). Data sources, memory devices, or memory components 106A, 106B, 106C, 106D, and/or 106E may include portions that are removable or non-removable and may include magnetic storage, optical storage, or electrical storage that may be local to or remote from system 100.

A record may comprise an instance of a parking venue or parking space with a set of attributes. For example, a record 202 for the instance of the parking venue "PMC Parking" may include attributes 206A, 206B, 206C, 206D such as address (710 SW Jefferson St), number of parking spaces (48), indoor/outdoor designation (indoor), type of parking (self), respectively. For another example, a record 204 for the instance of "ACE Lot" may include attributes 206A, 206B, 206C, 206D such as address (159 SW Jefferson St), number of parking spaces (26), indoor/outdoor designation (indoor), type of parking (valet only), respectively. While table 200 lists certain attributes corresponding to each parking venue or parking space, a person of ordinary skill in the art should know that any attribute that provides data associated with a parking venue or parking space comes within the scope of the present disclosure.

Model generating component 102 may access training data 104 from memory devices or components 106A, 106B, and/or 106C through a network 108, which may be a local area network, a wide area network, a global network, wired network, wireless network, or the like. Model generating component 102 may alternatively access training data 104 from memory device or component 106D through any communications interface or connection within system 100. Training data 104 may be stored in logical partitions of a single physical memory device or component or may be stored in distinct physical data sources, memory devices, or memory components located geographically near or distant from one another and/or from model generating component 102.

Model generating component 102 may generate model 110 from training data 104 containing records for several different parking venues or parking spaces. Model 110 may represent a set of correlation patterns automatically inferred from the statistical relationships across fields in training data 104. Model 110 may be used to make predictions of any sort including the availability of identified parking venues or parking spaces at any time. Model generating component 102 may store model 110 in memory device or component 106E.

In an embodiment, model generating component 102 may use a random forest machine learning technique to generate model 110. In other embodiments, model generating component 102 may use any other model generating techniques known to persons of ordinary skill in the art. Model generating component 102 may train model 110 using training data 104, e.g., parking location, season/month, day of the week, time of the day, nearby properties/real estate and the like and known output, e.g., whether parking is available or not. Model generating component 102 may train model 110 using random inputs and, once trained, computation component 120 may use model 110 to make real time prediction of parking availability based on input 118. In an embodiment, user input or feedback may be used to tune model 110 to obtain greater prediction accuracy. If model 110 falls below a certain threshold of accuracy as indicated for example by negative user feedback or other measures, model generating component 102 may retrain model 110 with additional training data 118 until accuracy improves beyond a predetermined measure, e.g., 90% accuracy.

Figure 3:
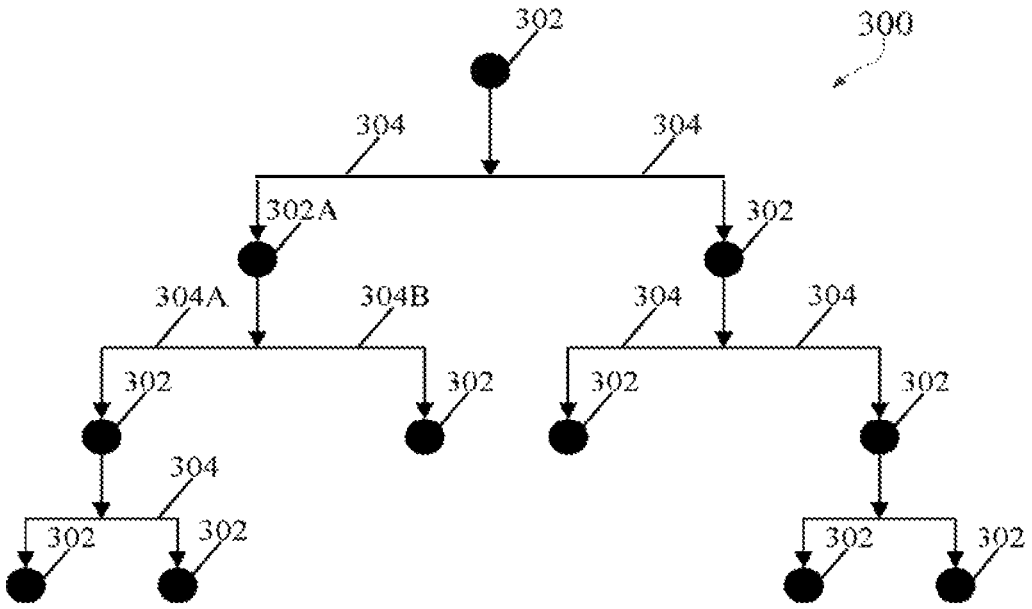

The graphical representation of model 110 is shown in FIG. 3 as a prediction tree 300. Referring to FIGS. 1 and 3, prediction tree 300 includes a plurality of nodes 302 interconnected with a plurality of branches 304. Nodes 302 may represent decisions, questions, fields, or branching criteria while branches 304 may represent possible outcomes or answers to the decisions, questions, fields, or branching criteria posed by nodes 302. For example, a node 302A may ask the question of whether a parking venue or parking space accepts cash payments. A first branch 304A connected to node 302A may be associated with a yes answer and a second branch 304B connected to node 302A may be associated with a no answer.

Models and prediction trees are known to those of ordinary skill in the art and are therefore not described in further detail. Model 110 may be represented by a prediction tree 300 that is binary (shown in FIG. 3), recursive, linear, non-linear, boosted, or otherwise.

User interface component 112 may receive input data 118 from a user 122 through input component 114, which may be any interface, graphical or otherwise, known to a person of ordinary skill in the art. For example, input component 114 may receive input data 118 from user 122 through the use of a mouse, a keyboard, touch screen, touch pad, voice, or any other known interface used alone or together with a monitor or display device. Input data 118 may include a destination address, a search string for a particular destination, identification of an event, identification of an event venue, or the like as identified by user 122 to input component 114. Input data 118 may further include calendar data, distance data, vehicle data, or preference data as identified by user 122 either substantially simultaneously with the identification of the destination address, search string, and so on or previously stored in system memory. Calendar data, in turn, may include a time of day, a day of a week, a day of a month, or a month of a year. Distance data may include preferences for distance, walking, driving, geographic, or otherwise, from the destination to available parking venues or parking spaces. For example, distance data may indicate a preference for walking no longer than a threshold distance, e.g., 2 city blocks, or between a set of bracketed distances, e.g., 0-50 yards. Vehicle data may include type, make, dimensions or size of the vehicle, or type of vehicle, e.g., standard or oversized, electric, and the like. Preference data may identify personal preferences for user 122 regarding parking venues or parking spaces, e.g., a fee structure preference, an hours of operation preference, a parking space size preference, an equipment preference, or the like.

Input component 114 may access input data 118 previously entered by user 122 and stored in any data store, memory device, or memory component of system 100. For example, input component 114 may access previously stored input data 118 that indicate a preference for indoor parking venues or parking spaces, hours of operation, and the like.

Input component 114 may access input data 118 previously entered by user 122 after obtaining consent to do so from user 122. Input component 114 may obtain consent by requesting an affirmative action of user 122 by e.g., having a dialog box displayed by presentation component 116 that requires user 122's affirmative consent by selecting radio buttons to opt-in for data collection. The dialog box may include an explanation identifying the data to be collected, the reason for data collection, a description of what the data will be used for, and/or the manner in which data will be collected by system 100. The dialog box may further include a link to a privacy policy associated with system 100 with further details regarding the handling of private user data. A person of ordinary skill in the art should realize that the present disclosure includes mechanisms, graphical or otherwise, other than dialog boxes or radio buttons for obtaining informed affirmative consent of user 122 for the collection of input data 118. In an embodiment, user 122 may view collected input data 118 and provide corrections where necessary. System 100 may include well known security measures to ensure that input data 118 collected from user 122 remains secure as appropriate for the sensitivity of the data.

User interface component 112 may present or display identified parking venues and parking spaces as well as a prediction of parking availability to user 122 through presentation component 116, which may be any kind of media known to a person of ordinary skill in the art. For example, presentation component 116 may include a graphical presentation device such as a display or monitor for viewing video, images, or text, or an audible presentation device such as a speaker for hearing audio, or a combination of both graphical and audio presentation devices. Presentation component 116 may present or display parking availability to user 122 through any user device such as smartphones, tablets, personal computers, vehicle presentation systems, and the like. User interface component 112 may use parking history to identify possible preferred parking venues and parking spaces near a destination. By doing so, user interface component 112 may speed up display and reduce the number of interactions required by a user to identify available parking venues and parking spaces and to predict their availability.

Computation component 120 may identify parking venues or parking spaces near a destination using training data 104 or by accessing publicly available information through network 108, e.g., municipality data, parking garage websites, forums, blog posts, and the like. Computation component 120 may identify parking venues by using collaborative filtering or crowd-sourced parking-related information as described in patent publication 2014/0266800 titled Crowd-Sourced Parking Advisory, incorporated herein by reference.

Computation component 120 may user personal parking history to identify parking venues or parking spaces. For example, if user 122 has a history of parking at a particular parking venue, computation component 120 may identify the particular parking venue in a situation where training data is old, cold, or otherwise out of date. System 100 may cache frequently visited places and nearby parking venues or parking spaces to avoid higher bandwidth usage when user 122 reaches the destination.

Computation component 120 may predict the availability of the identified parking venues or parking spaces by applying input data 118 to model 110, which, in turn, is generated based on training data 104.

Computation component 120 may further calculate a crowd index I and may predict the availability of the identified parking venues or parking spaces based on crowd index I. Crowd index I is configured to estimate a crowd at an event held at a venue within a threshold distance of the destination based at least in part on an event type T and/or a capacity C of the venue. Presentation component 116 may present the identified parking venue or parking spaces as well as corresponding parking predictions sorted based on crowd index I.

To calculate crowd index I, computation component 120 identifies an event occurring near the destination on a specific time or day that the search is conducted, on a specific time or day identified by user 122, or otherwise. Computation component 120 may identify the venue at which the event is to occur by, e.g., accessing sources 106A, 106B, 106C, or 106D over network 108. Computation component 120 may identify the event based on input data 118 or training data 104, e.g., on or about a time indicated in calendar data, on or about a time indicated in an Outlook® calendar entry for the meeting or an appointment, on or about a time user 122 inputs a search string, or the like. For example, computation component 120 may determine that the Portland Timbers play the Seattle Flounders within a predetermined time threshold (e.g., 30 minutes) from a scheduled meeting (as indicated by the user 122's Outlook® calendar) at a location within a predetermined distance (e.g., ¼ mile) of an identified venue (e.g., Providence Park).

Computation component 120 may categorize the identified event by an event type T and assign a weight to the event type T. For example, if computation component 120 determines that there are no events occurring near the destination, computation component 120 may assign a zero weight to event type T. For another example, if computation component 120 determines that a local event is occurring near the destination, computation component 120 may assign a 0.5 weight to event type T. For yet another example, if computation component 120 determines that a regional event is occurring near the destination, computation component 120 may assign a 1.0 weight to event type T. A person of ordinary skill in the art should realize that computation component 120 may assign smaller ranges of weights to event type T to obtain perhaps more granular (or more accurate) results. In the example of a Timbers game, computation component 120 may assign a weight of 1.0 to event type T since such an event is a highly attended regional game.

Computation component 120 may obtain a capacity C for the identified venue by, e.g., accessing sources 106A, 106B, 106C, or 106D over network 108. For example, computation component 120 may determine that the capacity C for Providence Park is 22,000. Computation component 120 may calculate crowd index I by multiplying the event T by the capacity C. Computation component 120 may additionally use any other factors that may affect attendance to calculate crowd index I, e.g., weather, calendar data, or cost of attendance.

Computation component 120 may receive or access input data 118 from other applications 124 on system 100, e.g., a calendar application such as Outlook® or personal assistant application such as Cortana®. For example, computation component 120 may access a destination from an Outlook® calendar entry for a meeting or an appointment in which the destination of the meeting is indicated.

Figure 4:
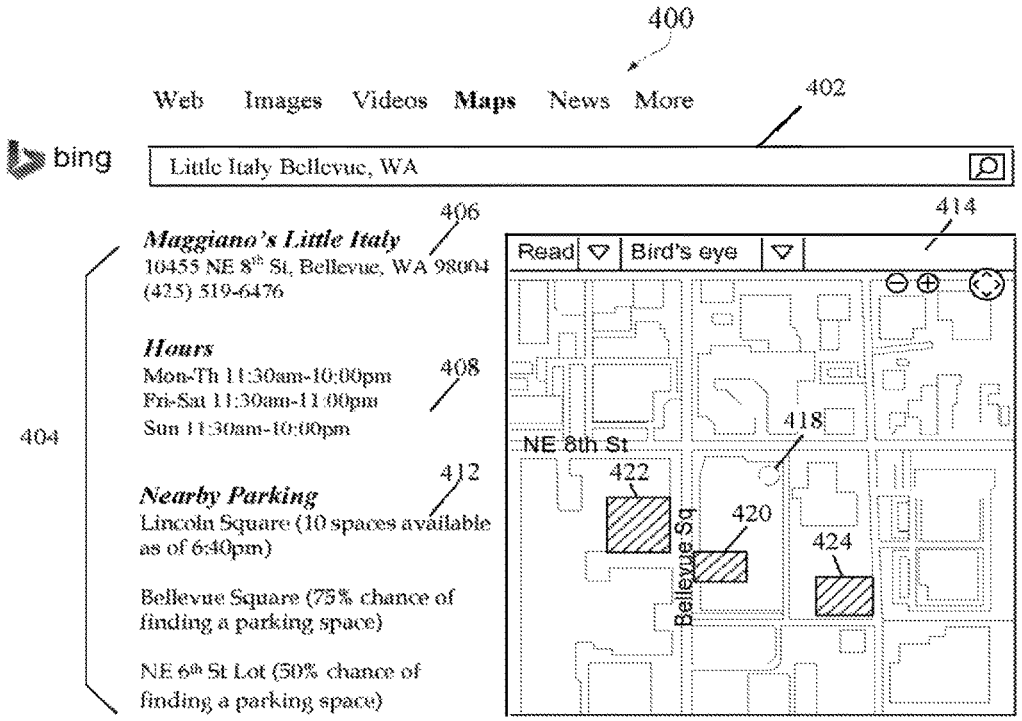
FIG. 4 is an exemplary graphical view of parking identification and availability prediction according to the present disclosure.
Figure 5:
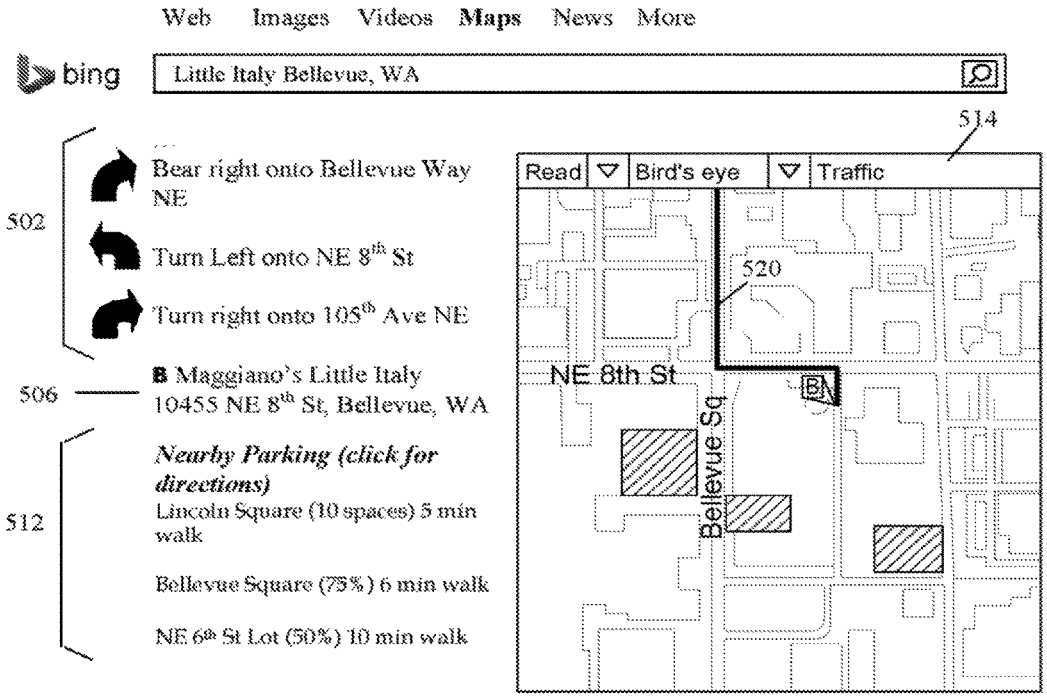
FIG. 5 is an exemplary graphical view of parking identification and availability prediction according to the present disclosure.
Figure 6:
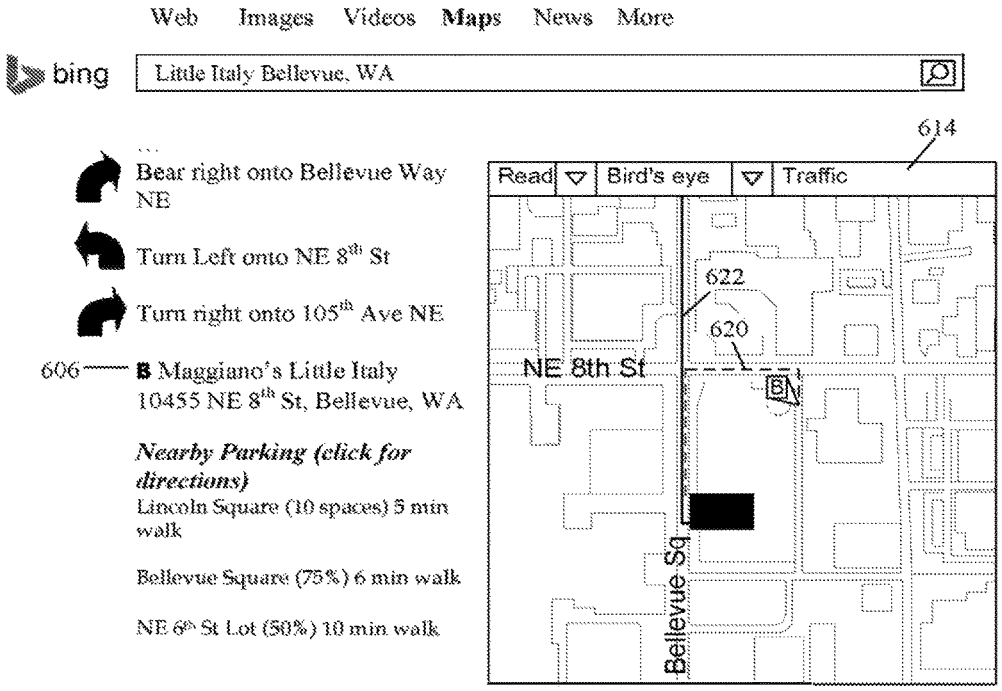
FIG. 6 is exemplary graphical view of parking identification and availability prediction according to the present disclosure.

FIGS. 4-6 are exemplary graphical views of parking identification and availability prediction according to the present disclosure. Referring to FIGS. 1 and 4-6, presentation component 116 may display a web search engine 400 such as Bing® or Google® in which user 122 (FIG. 1) may enter a search string 402, e.g., "Little Italy Bellevue, Wash." using any interface known to a person of ordinary skill in the art. Presentation component 116 may display results 404 of searching a network 108 for string 402. Results 404 may include an identification of a specific establishment 406 including an address 408 and hours of operation 410. Results 404 may further include a list 412 identifying nearby parking venues or parking spaces including a prediction of parking availability for each identified parking venue or parking space. For example, list 412 may include Lincoln Square with 10 spaces available as of 6:40 pm, Bellevue Square with a 75% chance of finding a parking space, and NE $6^{th}$ St Lot with a 50% chance of finding a parking space.

Presentation component 116 may additionally present a graphical view 414 as a street map identifying a location 418 of the specific establishment 406 and nearby parking venues and parking spaces 420 (Lincoln Square), 422 (Bellevue Square), and 424 (NE 6$^{th}$ St Lot) by any means of graphical highlighting known to a person of ordinary skill in the art. For example, graphical view 414 may highlight establishment 406 or identified parking venues or parking spaces 420, 422, or 424 using different colors, letters, numbers, graphical icons, line characteristics, optical effects, or the like. Presentation component 116 may further present graphical view 114 with the prediction of parking availability by, e.g., color coding the parking venues or parking spaces 420, 422, and 424 according to their availability. For example, graphical view 414 may color code parking venues or parking spaces as green when the likelihood of availability is greater than 80%, as yellow when the likelihood of availability is between 40% and 80%, or as red when the likelihood of availability is less than 40%. Alternatively, presentation component 116 may present the prediction of parking availability as a number or percentage fixedly appearing over the identified parking venue or parking space or dynamically appearing as a pop up window when a cursor hovers over the identified parking venue or parking space in graphical view 414 or list 412. Presentation component 116 may streamline user interaction with system 100 and effectively improve task completion by user 122. For example, presentation component 116 improves user 122's ability to interpret parking venue or parking space availability by dynamically color coding or by using other graphical highlighting means to display such data. For another example, presentation component 116 may identify the most available parking venues or parking spaces at any given time by sorting through results 404 to thereby reduce time to task completion for user 122.

Presentation component 116 may present a listing of directions 502 to destination 506 or a graphical representation of directions 520 to destination 506 as shown in FIG. 5. Presentation component 116 may additionally present a list 512 of nearby parking venues and parking spaces as well as a graphical view 514 showing nearby parking venues and parking spaces. Presentation component 116 may allow user 122 (FIG. 1) to click on or otherwise select a parking venue or parking space in list 512 or to click on or otherwise select a displayed parking venue or parking space in graphical view 514 to get directions to the selected parking venue or parking space. In an embodiment, presentation component 116 may display directions 620 to establishment 606 in graphical view 614 along with displaying directions 622 to a selected parking venue or parking spot near establishment 606 as shown in FIG. 6.

FIG. 7 is an embodiment of a method of identifying parking and predicting availability of identified parking. Referring to FIGS. 1, 2, and 7, a method 700 may retrieve training data at 702 from a plurality of data sources, e.g., data sources 106A, 106B, 106C, and 106D through a network or otherwise. At 704, method 700 may generate a model using training data such as that shown in Table 2. At 706, method 700 may receive input data including a destination in a geographical area from user 122 provided through an input component. At 708, method 700 may identify parking venues or parking spaces a predetermined distance from the destination by, e.g., searching for the destination using a search application or program according to the training data and input data. At 710, method 700 may predict availability of the identified parking venues or parking spaces by applying the input data to the model. At 712 and 714, the method may graphically present the identified parking venues or parking spaces as well as the availability prediction of the identified parking venues or parking spaces.

FIG. 8 is a block diagram of a system 800 for implementing an exemplary embodiment parking identification and availability prediction system 100. Referring to FIG. 8, system 800 includes a computing device 802. Computing device 802 may execute instructions of application programs or modules stored in system memory, e.g., memory 806. The application programs or modules may include components, objects, routines, programs, instructions, data structures, and the like that perform particular tasks or functions or that implement particular abstract data types as discussed above. Some or all of the application programs may be instantiated at run time by a processing device 804. A person of ordinary skill in the art will recognize that many of the concepts associated with the exemplary embodiment of system 800 may be implemented as computer instructions, firmware, or software in any of a variety of computing architectures, e.g., computing device 802, to achieve a same or equivalent result.

Moreover, a person of ordinary skill in the art will recognize that the exemplary embodiment of system 800 may be implemented on other types of computing architectures, e.g., general purpose or personal computers, handheld devices, mobile communication devices, gaming devices, music devices, photographic devices, multi-processor systems, microprocessor-based or programmable consumer electronics, minicomputers, mainframe computers, application specific integrated circuits, and like. For illustrative purposes only, system 800 is shown in FIG. 8 to include computing devices 802, geographically remote computing devices 802R, tablet computing device 802T, mobile computing device 802M, and laptop computing device 802L. A person of ordinary skill in the art may recognize that computing device 802 may be embodied in any of tablet computing device 802T, mobile computing device 802M, or laptop computing device 802L. Similarly, a person of ordinary skill in the art may recognize that the parking identification and availability prediction system 100 may be implemented in computing device 802, geographically remote computing devices 802R, and the like. Mobile computing device 802M may include mobile cellular devices, mobile gaming devices, mobile reader devices, mobile photographic devices, and the like.

A person of ordinary skill in the art will recognize that an exemplary embodiment of system 800 may be implemented in a distributed computing system in which various computing entities or devices, often geographically remote from one another, e.g., computing device 802 and remote computing device 802R, perform particular tasks or execute particular objects, components, routines, programs, instructions, data structures, and the like. For example, the exemplary embodiment of system 800 may be implemented in a server/client configuration (e.g., computing device 802 may operate as a server and remote computing device 802R may operate as a client). In distributed computing systems, application programs may be stored in local memory 806, external memory 836, or remote memory 834. Local memory 806, external memory 836, or remote memory 834 may be any kind of memory, volatile or non-volatile, removable or non-removable, known to a person of ordinary skill in the art including random access memory (RAM), flash memory, read only memory (ROM), ferroelectric RAM, magnetic storage devices, optical discs, and the like.

The computing device 802 comprises processing device 804, memory 806, device interface 808, and network interface 810, which may all be interconnected through bus 812. The processing device 804 represents a single, central processing unit, or a plurality of processing units in a single or two or more computing devices 802, e.g., computing device 802 and remote computing device 802R. The local memory 806, as well as external memory 836 or remote memory 834, may be any type memory device known to a person of ordinary skill in the art including any combination of RAM, flash memory, ROM, ferroelectric RAM, magnetic storage devices, optical discs, and the like. The local memory 806 may store a basic input/output system (BIOS) 806A with routines executable by processing device 804 to transfer data, including data 806E, between the various elements of system 800. The local memory 806 also may store an operating system (OS) 806B executable by processing device 804 that, after being initially loaded by a boot program, manages other programs in the computing device 802. Memory 806 may store routines or programs executable by processing device 804, e.g., application 806C, and/or the programs or applications 806D generated using application 806C. Application 806C may make use of the OS 806B by making requests for services through a defined application program interface (API). Application 806C may be used to enable the generation or creation of any application program designed to perform a specific function directly for a user or, in some cases, for another application program. Examples of application programs include word processors, database programs, browsers, development tools, drawing, paint, and image editing programs, communication programs, and tailored applications as the present disclosure describes in more detail, and the like. Users may interact directly with computing device 802 through a user interface such as a command language or a user interface displayed on a monitor (not shown).

Device interface 808 may be any one of several types of interfaces. The device interface 808 may operatively couple any of a variety of devices, e.g., hard disk drive, optical disk drive, magnetic disk drive, or the like, to the bus 812. The device interface 808 may represent either one interface or various distinct interfaces, each specially constructed to support the particular device that it interfaces to the bus 812. The device interface 808 may additionally interface input or output devices utilized by a user to provide direction to the computing device 802 and to receive information from the computing device 802. These input or output devices may include voice recognition devices, gesture recognition devices, touch recognition devices, keyboards, monitors, mice, pointing devices, speakers, stylus, microphone, joystick, game pad, satellite dish, printer, scanner, camera, video equipment, modem, monitor, and the like (not shown). The device interface 808 may be a serial interface, parallel port, game port, firewire port, universal serial bus, or the like.

A person of ordinary skill in the art will recognize that the system 800 may use any type of computer readable medium accessible by a computer, such as magnetic cassettes, flash memory cards, compact discs (CDs), digital video disks (DVDs), cartridges, RAM, ROM, flash memory, magnetic disc drives, optical disc drives, and the like. A computer readable medium as described herein includes any manner of computer program product, computer storage, machine readable storage, or the like.

Network interface 810 operatively couples the computing device 802 to one or more remote computing devices 802R, tablet computing devices 802T, mobile computing devices 802M, and laptop computing devices 802L, on a local or wide area network 830. Computing devices 802R may be geographically remote from computing device 802. Remote computing device 802R may have the structure of computing device 802, or may operate as server, client, router, switch, peer device, network node, or other networked device and typically includes some or all of the elements of computing device 802. Computing device 802 may connect to network 830 through a network interface or adapter included in the interface 810. Computing device 802 may connect to network 830 through a modem or other communications device included in the network interface 810. Computing device 802 alternatively may connect to network 830 using a wireless device 832. The modem or communications device may establish communications to remote computing devices 802R through global communications network 830. A person of ordinary skill in the art will recognize that application programs 806D or modules 806C might be stored remotely through such networked connections. Network 830 may be local, wide, global, or otherwise and may include wired or wireless connections employing electrical, optical, electromagnetic, acoustic, or other carriers.

The present disclosure may describe some portions of the exemplary system using algorithms and symbolic representations of operations on data bits within a memory, e.g., memory 806. A person of ordinary skill in the art will understand these algorithms and symbolic representations as most effectively conveying the substance of their work to others of ordinary skill in the art. An algorithm is a self-consistent sequence leading to a desired result. The sequence requires physical manipulations of physical quantities. Usually, but not necessarily, these quantities take the form of electrical or magnetic signals capable of being stored, transferred, combined, compared, and otherwise manipulated. For simplicity, the present disclosure refers to these signals as bits, values, elements, symbols, characters, terms, numbers, or like. The terms are merely convenient labels. A person of skill in the art will recognize that terms such as computing, calculating, generating, loading, determining, displaying, or like refer to the actions and processes of a computing device, e.g., computing device 802. The computing device 802 may manipulate and transform data represented as physical electronic quantities within a memory into other data similarly represented as physical electronic quantities within the memory.

It will also be appreciated by persons of ordinary skill in the art that the present disclosure is not limited to what has been particularly shown and described hereinabove. Rather, the scope of the present disclosure includes both combinations and sub-combinations of the various features described hereinabove as well as modifications and variations which would occur to such skilled persons upon reading the foregoing description. Thus the disclosure is limited only by the appended claims.

The invention claimed is:

1. A system, comprising:

a model generating component to generate a parking prediction model based on training data;

an input component to receive input data, the input data including a destination and calendar information;

a computation component configured to:

identify at least one parking venue near the destination;

identify an event occurring at an event venue near the destination based on the calendar information;

retrieve a capacity for the event venue and an event type for the identified event;

calculate a crowd index based on the retrieved capacity and event type, wherein the crowd index is indicative of an estimate of a crowd size at the destination; and generate at least one parking prediction corresponding to the at least one parking venue based at least in part on applying the input data and the calculated crowd index to the parking prediction model;

a presentation component to present the at least one parking venue and the at least one parking prediction to a user; and a microprocessor to execute computer-executable instructions associated with at least one of the model generating component, the input component, the computation component, or the presentation component.

2. The system of claim 1, wherein the event venue near the destination is within a threshold distance of the destination.

3. The system of claim 1, wherein the model generating component is further configured to access the training data from at least one data source.

4. The system of claim 1, wherein the training data comprises records for each of a plurality of parking venues, each parking venue having associated therewith an address, a number of parking spaces, an indoor or outdoor designation, a type of parking service offered, a size of each of the number of parking spaces, fee structure, hours of operation, on-site equipment, limitations, or payment options.

5. The system of claim 1, wherein the input data further comprises distance data, vehicle data, or preference data.

6. The system of claim 5, wherein the distance data comprises walking distance, driving distance, or geographical distance between the destination and a parking venue.

7. The system of claim 5, wherein the vehicle data comprises type of vehicle, make of the vehicle, or dimensions of the vehicle.

8. The system of claim 5, wherein the preference data comprises a fee structure preference, an hours of operation preference, a parking space size preference, or an equipment preference.

9. The system of claim 1, wherein the calendar information includes a time for a scheduled meeting.

10. The system of claim 1, wherein the presentation component is further configured to present the at least one parking prediction sorted based upon the crowd index.

11. A computer-implemented method, comprising:

generating a parking prediction model based on training data;

receiving input data, the input data including a destination and calendar information;

identifying at least one parking venue near the destination;

identifying an event occurring at an event venue near the destination based on the calendar information;

retrieving a capacity for the event venue and an event type for the identified event;

calculating a crowd index based on the retrieved capacity and the event type, wherein the crowd index is indicative of an estimate of a crowd size at the destination;

determining at least one parking prediction corresponding to the identified at least one parking venue based at least in part on applying the input data and the calculated crowd index to the parking prediction model; and presenting the identified at least one parking venue and the at least one parking prediction to a user.

12. The method of claim 11, wherein the event venue near the destination is within a threshold distance of the destination.

13. The method of claim 11, wherein the training data comprises a plurality of records corresponding to a plurality of parking venues, each parking venue having associated therewith an address, a number of parking spaces, an indoor or outdoor designation, a type of parking service offered, a size of each of the number of parking spaces, fee structure, hours of operation, on-site equipment, limitations, or payment options; and wherein the input data comprises calendar data, distance data, vehicle data, or preference data.

14. The method of claim 13, wherein the calendar data comprises time of day, the day of a week, the day of a month, or the month of a year;

wherein the distance data comprises walking distance, driving distance, or geographical distance between the destination and a parking venue;

wherein the vehicle data comprises type of vehicle, make of the vehicle, or dimensions of the vehicle; and wherein the preference data comprises a fee structure preference, an hours of operation preference, a parking space size preference, or an equipment preference.

15. The method of claim 14, further comprising:

presenting the at least one parking prediction sorted based upon the crowd index.

16. A computer program product, the computer program product stored on a non-transitory computer-readable medium and including instructions configured to cause a processor to execute steps comprising:

generating a parking prediction model based on training data;

receiving input data, the input data including a destination and calendar information;

identifying at least one parking venue near the destination;

identifying an event occurring at an event venue near the destination based on the calendar information;

retrieving a capacity for the event venue and an event type for the identified event;

calculating a crowd index based on the retrieved capacity and the event type, wherein the crowd index is indicative of an estimate of a crowd size at the destination;

determining at least one parking prediction corresponding to the identified at least one parking venue based at least in part on applying the input data and the calculated crowd index to the parking prediction model; and presenting the identified at least one parking venue and the at least one parking prediction to a user.

17. The computer program product of claim 16 wherein the event venue near the destination is within a threshold distance of the destination.

18. The computer program product of claim 16, wherein the training data comprises a plurality of records corresponding to a plurality of parking venues, each parking venue having associated therewith an address, a number of parking spaces, an indoor or outdoor designation, a type of parking service offered, a size of each of the number of parking spaces, fee structure, hours of operation, on-site equipment, limitations, or payment options; and wherein the input data comprises calendar data, distance data, vehicle data, or preference data.

19. The computer program product of claim 18, wherein the calendar data comprises time of day, the day of a week, the day of a month, or the month of a year;

wherein the distance data comprises walking distance, driving distance, or geographical distance between the destination and a parking venue;

wherein the vehicle data comprises type of vehicle, make of the vehicle, or dimensions of the vehicle; and wherein the preference data comprises a fee structure preference, an hours of operation preference, a parking space size preference, or an equipment preference.

20. The computer program product of claim 19, further comprising:

presenting the at least one parking prediction sorted based upon the crowd index.

* * * * *